US005980717A

United States Patent [19]

Pudas et al.

[11] Patent Number: 5,980,717

[45] Date of Patent: Nov. 9, 1999

[54] RECOVERY PROCESS IN A PULP MILL

[75] Inventors: Roland Pudas, Nödinge; Magnus Linsten, Kungälv; Roy Hammer-Olsen, Ljungaverk; Björn Svedin, Njurunda; Ingrid Velander, Indal, all of Sweden

[73] Assignee: Eka Chemical AB, Bohus, Sweden

[21] Appl. No.: 08/999,430

[22] Filed: Dec. 29, 1997

Related U.S. Application Data

[60] Provisional application No. 60/035,178, Jan. 23, 1997.

[30] Foreign Application Priority Data

Jan. 3, 1997 [SE] Sweden ..... 9700012

[51] Int. Cl.[6] ..... B01D 59/42

[52] U.S. Cl. ..... 204/536; 210/660; 423/181

[58] Field of Search ..... 210/660; 423/181; 204/539, 542, 536

[56] References Cited

U.S. PATENT DOCUMENTS

| | | | |
|---|---|---|---|
| 3,684,672 | 8/1972 | Iwahashi et al. | 204/128 |
| 4,477,355 | 10/1984 | Liberti et al. | 210/665 |
| 5,352,332 | 10/1994 | Maples et al. | 162/30.1 |
| 5,567,293 | 10/1996 | Paleologou et al. | 204/523 |
| 5,628,874 | 5/1997 | Lindberg et al. | 162/30.1 |

FOREIGN PATENT DOCUMENTS

| | | | |
|---|---|---|---|
| 0 754 799 | 1/1997 | European Pat. Off. | D21C 11/06 |
| WO 94/04747 | 3/1994 | WIPO | D21C 11/04 |

OTHER PUBLICATIONS

Metals Management in a Closed Kraft Mill Bleach Plant, 1994 Pulping Conference, pp. 1155–1160.

*European Search Report*, dated Feb. 2, 1998.

*Primary Examiner*—Kathryn Gorgos
*Assistant Examiner*—Thomas H Parsons
*Attorney, Agent, or Firm*—Ralph J. Mancini

[57] ABSTRACT

A substantial and increasing problem with the pulping chemical recovery system, is the presence of chloride and potassium in the spent liquor entering the recovery boiler. Chloride and potassium increase the stickiness of carryover deposits and dust particles to the recovery boiler tubes, which accelerate fouling and plugging in the upper part of the recovery boiler. The present invention relates to a process by which the content of potassium ions in a recovery system for pulping chemicals can be reduced. The process comprises bringing spent liquor to a recovery boiler, burning said spent liquor, collecting precipitator dust formed, forming a solution by dissolving the precipitator dust in a liquid, where the solution of precipitator dust is subjected to a treatment with an inorganic ion exchange material in order to remove at least a part of the potassium therein.

10 Claims, 1 Drawing Sheet

RECOVERY PROCESS IN A PULP MILL

RECOVERY PROCESS IN A PULP MILL

The present case claims priority of Swedish application No. 9700012-9 filed Jan. 3, 1997 and of U.S. Provisional application No. 60/035178 filed Jan. 23, 1997.

FIELD OF THE INVENTION

The present invention relates to an environmental-friendly process for reducing the content of potassium ions in a liquid inventory of a chemical pulp mill.

BACKGROUND OF THE INVENTION

In the production of a chemical pulp, chips of lignocellulose-containing material are cooked in an alkaline or acid aqueous solution. This cooking liquid contains inorganic pulping chemicals to improve the dissolution of lignin. The cooking is normally carried out at a temperature of above 100° C. to reduce the residence time for the pulp produced. Therefore, the cooking is carried out in a pressure vessel known as a digester.

In the production of sulphate pulp, soda pulp and sulphite pulp with an alkali metal as a base, normally sodium, it is possible to recover the inorganic pulping chemicals in the spent liquor leaving the digester. It is vital both to the economy and the environment to recover these pulping chemicals to the largest possible extent. This is achieved in the pulping chemical recovery system, which essentially transfers the used inorganic pulping chemicals into a chemical state, where they can be re-used for cooking.

An essential part of the recovery system is the recovery boiler, where the spent liquor is burned. Normally, make-up chemicals are added to the spent liquor before the recovery boiler to make up for the chemicals lost during cooking and recovery. The spent liquor is sprayed into the lower part of the boiler, previously at a relatively low temperature to remove free water. Modern recovery boilers operate at a high temperature to reduce the content of sulphur in the flow gases leaving the boiler. Higher up in the boiler, gases and vapours of light hydrocarbons and decomposition products are volatilized. This is known as pyrolysis. Then, the pyrolysis products are burned after mixing with air or oxygen. The solid carbon-based residue which remains after complete pyrolysis of the organics is then heterogeneously burned. The solid particles formed are collected as a dust in precipitators at the top of the recovery boiler, to reduce the release of solid material to the surrounding atmosphere.

A substantial and increasing problem with the pulping chemical recovery system, is the presence of chloride and potassium in the spent liquor entering the recovery boiler. These elements tend to reduce the capacity of the recovery boiler to produce useful chemicals. Thus, chloride and potassium increase the stickiness of carryover deposits and dust particles to the recovery boiler tubes, which accelerate fouling and plugging in the upper part of the recovery boiler. Chloride also tends to increase the corrosion rate of superheater tubes.

Chloride and potassium are concentrated in the dust formed during the combustion of spent liquor in the recovery boiler. The dust is collected in dry-bottom or wet-bottom electrostatic precipitators. The dust mainly consists of sodium and potassium salts, where sulphate, carbonate and chloride are the dominant anions. The amount of dust corresponds to from about 5 up to about 15% by weight of the sodium entering the recovery boiler, which corresponds to from about 50 up to about 150 kg dust per tonne pulp, if the dust is calculated as sodium sulphate.

Today, normally all of the precipitator dust collected and withdrawn from the recovery boiler is recycled to the flow of spent liquor to be burned in the boiler. When the concentration of chloride or potassium is too high, a portion of the precipitator dust is withdrawn from the system and discharged or deposited.

The largest source of potassium is the wood, and the intake will depend on the wood source generally varying from about 0.5 to 5 kg per tonne pulp. The hardwood species usually contains larger amounts of potassium than softwood species. Besides, the content of chloride in the spent liquor can be very high for coastal mills, if the raw material consists of logs floated in seawater. As the environmental legislation becomes more stringent regarding pulp mill discharges to air and water, the degree of system closure increases. This means that even a small input of chloride and potassium becomes a severe problem, unless the content can be controlled by purging the system in some environmentally acceptable way.

Several methods have been proposed to overcome the problem with chloride and potassium build-up in pulping chemical recovery systems. The use of organic ion exchangers have been proposed as a unit operation for treatment of precipitator dust, but this has mainly been for softening purposes, e.g. to reduce the content of multivalent metals that would harm membranes in subsequent electrolysis of the precipitator dust. Chloride and potassium removal are preferably carried out in a common waste water treatment. Chloride can be removed efficiently by e.g. electrodialysis, while potassium still is difficult to remove efficiently electrochemically.

For instance, WO-A1-9404747 discloses a process, in which the content of chloride in a recovery system for pulping chemicals can be reduced. The process comprises collecting precipitator dust, dissolving the dust in water to produce an aqueous solution of precipitator dust, whereupon said aqueous solution is electrolysed in a cell for production of chlorine or hydrochloric acid in the anolyte. Use of ion exchange is suggested as a pretreatment before the electrolyses, chiefly to remove divalent ions such as $Ca^{2+}$ and $Mg^{2+}$.

Caron J. R. et al, "Metals management in a closed kraft mill bleach plant", Pulping Conference, TAPPI (1995), p. 1155–1160, have investigated metals removal from recycled chlorine dioxide bleach plant filtrate with ion exchange resins. The present invention overcomes many of the deficiencies of the prior art by providing an improved process by which the content of potassium ions in a recovery system for pulping chemicals can be reduced.

SUMMARY OF THE INVENTION

The present invention generally relates to a process by which the content of potassium ions in a recovery system for pulping chemicals can be reduced. The process comprises bringing spent liquor to a recovery boiler, burning said spent liquor, collecting precipitator dust formed, forming a solution by dissolving the precipitator dust in a liquid, where the solution of precipitator dust is subjected to a treatment with an inorganic ion exchange material in order to remove at least a part of the potassium therein.

DETAILED DESCRIPTION OF THE INVENTION

The present process is directed to reducing the content of potassium ions in a recovery system for pulping chemicals.

The process comprises bringing spent liquor to a recovery boiler, burning said spent liquor, collecting precipitator dust formed, forming a solution by dissolving the precipitator dust in a liquid, where the solution of precipitator dust is subjected to a treatment with an inorganic ion exchange material in order to remove at least a part of the potassium therein.

An advantage of the present process is the possibility to reduce the content of potassium in the liquid inventory and more particularly in the spent liquor entering the recovery boiler. By the present process, the problem of sticky deposits in the recovery boiler can be substantially reduced. This means an improved energy efficiency as well as a higher degree of recovery of the pulping chemicals.

The present invention can be used in the production of a chemical pulp and especially for production of a sulphate pulp, soda pulp or sulphite pulp with an alkali metal as base. A kraft pulp is a special type of sulphate pulp, where the pulp is under-cooked to produce a dark-coloured pulp of exceptional strength. The present invention can also be used in the production of sulphate, soda or sulphite pulps with an alkali metal as base, where the cooking processes have been modified, combined or extended compared to the normal pulping techniques. Suitably, the present process is applied where the recovery system for pulping chemicals is a kraft recovery system.

A liquid inventory is the total quantity of various liquids in a mill, with varying contents of active or activatable cooking liquid components. The liquid inventory of a sulphate mill, mainly consists of white liquor, black liquor, green liquor and spent liquor entering the recovery boiler. The spent liquor to be burned in the present process, is a used cooking liquid withdrawn from a digester, optionally with added make-up chemicals. Potassium and sodium are alkali metals present in the spent liquors.

The amount of precipitator dust formed depends mainly on the temperature in the boiler, the ratio between sodium and sulphur in the spent liquor and the raw material and sulphidity of the cooking process. A high temperature in the lower part of the boiler to reduce the sulphur content in the flow gases, increases the amount of dust formed.

With the present process, all or a portion of the precipitator dust collected and withdrawn from the recovery system is treated with an inorganic ion exchange material.

The composition of precipitator dust formed in recovery boilers vary considerably depending on type and origin of wood, cooking process, purity of make-up chemicals, temperature in the boiler, type of precipitator etc. However, irrespective of these factors the dust mainly consists of sodium and potassium salts, where sulphate, carbonate and chloride are the dominant anions. A typical composition of precipitator dust from a kraft recovery system is $Na_2SO_4$ 80–85% by weight, $Na_2CO_3$ 2–8% by weight, NaCl 2–8% by weight, $NaHSO_4$+$Na_2S_2O_7$<2% by weight, $K_2SO_4$ 5–10% by weight, $K_2CO_3$ 0.5–1% by weight, KCl<1% by weight, metal ions such as Ca, Fe, Mg, P, Si, Mn, Zn, Mo<1% by weight and organic material<1% by weight.

Natural as well as synthetic inorganic ion exchange material can be used. Suitable inorganic ion exchange materials are aluminosilicates, hydrous oxides, acid salts of polyvalent metals or salts of heteropolyacids. Preferably use is made of aluminosilicates such as zeolites, and most preferably zeolites are used as ion exchange material.

Zeolites are inorganic crystalline compounds mainly consisting of $SiO_2$ and $Al_2O_3$ in tetrahedral co-ordination. In the present invention, zeolites also relate to other crystalline compounds of zeolite structure, such as aluminium phosphates. Such crystalline compounds of zeolite structure which can be used in the present invention are defined in W. M. Meier et al, Atlas of zeolite structure types, sec. ed., Butterworths, London, 1987, which is hereby incorporated by reference in the present application. Many zeolites occur naturally, but most commercially used zeolites are synthetically produced. These zeolites function as adsorbents or molecular sieves and may, depending on the size of the cavities and the nature of the zeolite surface, be used to increase or decrease the taking-up of specific chemical compounds. In the present invention, a very essential property of the zeolites is their selectivity towards potassium relative to sodium.

A suitable zeolite can be selected from the group consisting of mordenite, chabazite, clinoptilolite, zeolite A and zeolite Y. Preferably use is made of mordenite. A wide variety of zeolites are available on the market. For instance, Wessalith P is a A-zeolite manufactured by Degussa. Zeolite Y EY250, Zeolite Y N3S, Zeolite BMH and Zeolite Sodium Mordenite EM120 is manufactured by Eka Chemicals AB.

Example of hydrous oxides which can be used are hydrous titanium oxide, iron hydroxide, hydrous stannic oxide, hydrous zirconium oxide, silica gel etc. Crystalline antimonic acid is known to exhibit the following selectivity series Li>K>Rb>Na.

Suitable acid salts of polyvalent metals used as ion exchange material may be zirconium phosphate crystal or titanium phosphate crystals.

The amount of inorganic ion exchange material used may vary within wide limits. Thus, the amount of inorganic ion exchange material used may be up to 1 tonne/tonne of dry precipitator dust and e.g. lie in the range of from about 1 kg/tonne up to about 1000 kg/tonne of dry precipitator dust, suitably in the range of from about 10 kg/tonne up to about 1000 kg/tonne of dry precipitator dust and preferably in the range of from about 100 kg/tonne up to about 500 kg/tonne of dry precipitator dust. Suitably, the amount of inorganic ion exchange material used is based upon the ion exchange capacity of the actual inorganic material and the amount of potassium in the precipitator dust. The inorganic ion exchange material is preferably used in excess of the stoichiometric amount of potassium.

The potassium and chloride containing solution is treated with an inorganic ion exchange material. The ion exchanged material, enriched with potassium, is then preferably filtered and washed with water, whereafter the spent ion exchanger material can be deposited in a land fill. The solution depleted of potassium and chloride, can be recycled in the pulp mill or forwarded to another step in the treatment of precipitator dust for mixing or dilution. The separation and washing can preferably take place in a centrifuge, a filter press or a vacuum filter.

Alternatively, after separating the ion exchanged slurry from the solution, it can be regenerated with a sodium rich aqueous solution. This could for example be a solution of the $Na_2SO_4$ salt cake obtained from a chlorine dioxide generator (or from a crystallisator, or a chloride concentrate from an electrochemical cell). Separation, washing, regeneration and dewatering then may take place in the same piece of equipment operating in a continues mode. Even the ion exchange may take place in the separation equipment. This can be done batchwise in a filter press or continues eg. in a centrifuge or a rotating filter of vacuum or pressure type.

In an embodiment of the present invention, the inorganic ion exchange material is made in the form of granules or pellets and are placed as a fixed bed in a column, thus forming an ion exchanger. The precipitator dust solution, rich with potassium, is forced to flow through the bed of ion exchange material to which the potassium is adsorbed. The reaction zone proceeds down the column as the upper layers of ion exchange material reaches equilibrium with the solution. At the end of the work cycle when the ion exchanger becomes exhausted, the ion exchange material is backwashed (regenerated) with a sodium electrolyte. The flow of potassium rich solution is simultaneously switched to another column. A number of columns can be arranged in parallel so that continuous operation is ensured. The advantage with this embodiment, columns arranged in parallel, over the previously described is that the operation is continuous and that a more efficient ion exchange can be achieved as multiple equilibrium stages are obtained (cf. McKabe-Thiele diagram).

The amount of potassium removed in a precipitator dust solution subjected to a treatment with an inorganic ion exchange material, can be above about 40%, suitably above about 50%, preferably above about 60% and most preferred above about 70%.

A potassium free or potassium depleted stream which has undergone the inorganic ion exchange, is preferably recycled to the weak black liquor or may, in the cases where the water balance allows, be mixed with the strong black liquor and fed directly into the recovery boiler in the recovery system.

A solution of precipitator dust will also commonly have a pH between about 7 and about 11, within which range most ion exchange materials are stable and thus preferred. However, the pH is not critical since many ion exchange material work satisfactory outside the pH range 7–11.

The ion exchange is suitably performed in the range from above 0° C. up to about 100° C. and preferably from about 20° C. up to about 60° C.

The residence time for the suitable batchwise ion exchange is preferably at least about 1 minute. Suitably the residence time is at least about 1 hour, preferably at least about 2 hours and most preferred at least about 5 hours. The upper residence time is not critical, but has to be set by process-technical reasons. The flow rate for the suitable continuous operation of the ion exchange is suitably at least from about 0.1 up to 20 BV/h (Bed Volume per hour), preferably from about 1 up to 10 BV/h and most preferred from about 2 up to 6 BV/h. The ion exchange is preferably carried out by a continuous operation.

In one embodiment of the invention the potassium concentration of the solution is increased by leaching the precipitator dust with a liquor. The added liquid may comprise water, or water solutions of sulphate or carbonate. Added sulphate may be alkali metal, preferably sodium sulphate, suitably at least a part derived from a recirculated solution, depleted of chloride and potassium, for instance from a suitable electrochemical treatment or recrystallisation. If water is added, it can be either fresh water or purified process water. The potassium enriched leach solution is separated from the solid phase of the leached precipitator dust, by e.g. filtration, centrifugation, sedimentation etc..

The concentrate in the slurry obtained from the leaching step may comprise from about 1 g/l up to about 60 g/l potassium, and will be saturated with sulphate.

The solution depleted of potassium obtained from the ion exchange may comprise from 0 g/l up to about 60 g/l potassium (counted as e.g. $K^+$, $K_2SO_4$, KCl).

The inorganic ion exchange according to the present invention is preferably combined with another process. This could for example be a process for leaching and electrodialysis of precipitator dust. The ion exchange can also be combined with processes where precipitator dust is split in electrolysis cell or a electrodialysis cell with bipolar membranes. The advantage is, especially when removing the potassium prior to electrolysis, that NaOH with little or no potassium impurities can be prepared.

The inorganic ion exchange according to the present invention can also be combined with a process where sodium sulphate is re-crystallised from the precipitator dust. In another embodiment, the inorganic ion exchange according to the present invention can be advantageously combined with a process where chloride ions are ion exchanged from the precipitator dust (for instance the Precipitator Dust Purification System, PDP™).

Another possible application is to use the inorganic ion exchange according to the present invention on bleach filtrates recovered back to the chemical recovery.

BRIEF DESCRIPTION OF THE DRAWINGS

Embodiments of the process of the present invention will now be described in more detail with reference to the figures.

Figure 1:
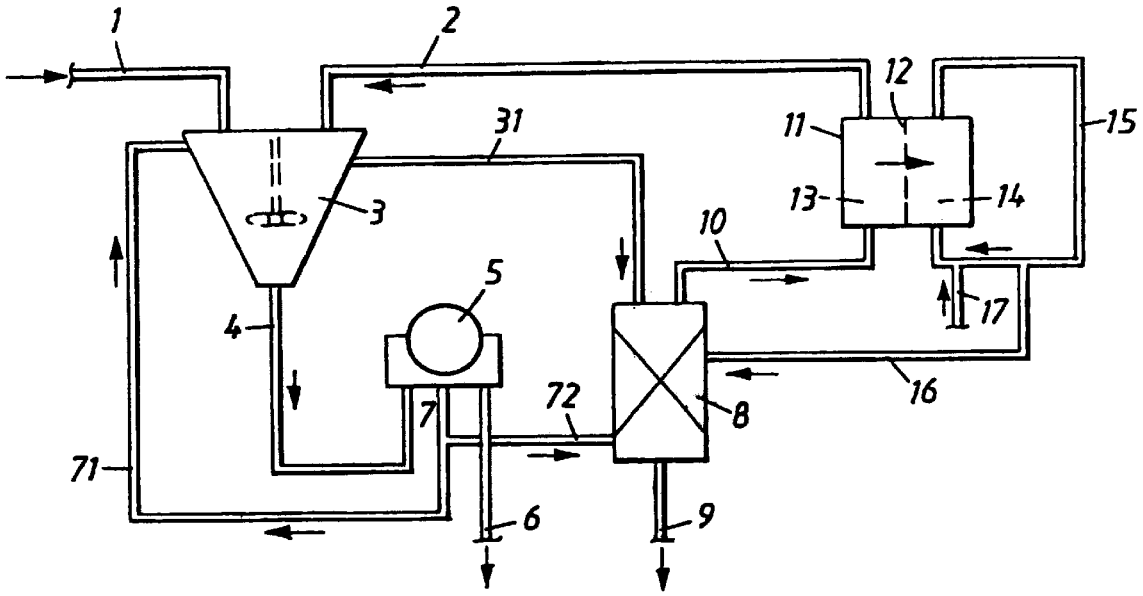
FIG. 1 shows a schematic description of the use of an inorganic ion exchanger in a process for treatment of precipitator dust applying a combination of leaching and electrodialysis treatments.

In the embodiment of FIG. 1, precipitator dust (1) can be mixed with a near saturated solution of sodium sulphate (2) in a leach tank (3) where the mixed solution can be subjected to a leaching treatment. The chloride and potassium compounds in the precipitator dust are leached out and the potassium and chloride enriched solution (31) is brought to an ion exchange column (8). A slurry (4) is separated on a filter (5), a centrifuge (not shown) or the similar. The filter cake (6), virtually free of chloride and potassium, is recovered to the strong black liquor. The filtrate (7) is recycled (71) to the leach tank (3) or forwarded (72) to the ion exchange column (8) where potassium ions are removed (9), and the potassium depleted filtrate, still containing a high concentration of chloride ions (10), can be further brought to the diluate chamber(s) (13) of an electrodialysis stack (11) holding mono-anion selective membranes (12). When an electric field is applied to the electrodialysis stack the chloride ions are removed by migration through the anion selective membranes to the concentrate (brine) chamber(s) (14). The remaining chloride and potassium depleted sodium sulphate solution (2) can be recycled for use as leachant in the first step (3). The electrodialysis stack (11) may also comprise cation selective membranes through which cations such as sodium and potassium are removed by migration. The concentrated sodium chloride solution prepared in the electrodialysis step (15) can be recirculated back to the concentrate chamber(s) of the cell, but a part may be purged and used for regenerating (16) the ion exchange material. In addition, water can be added to dilute the concentrated chloride solution (17).

The advantage with implementing potassium ion exchange in the process described in FIG. 1 is obvious. Chloride and sulphate ions can efficiently be separated in the electrodialyser as the divalent sulphate ions will be repelled by the mono-anion selective membranes. Unfortunately, cation exchange membranes cannot exhibit a similar selectivity for potassium versus sodium. Consequently, only a minor part of the potassium will be removed in the electrodialysis step and without any selective potassium removal the concentration of potassium will increase in the solution until the solubility limit for glacerite ($NaK_3(SO_4)_2$) is reached. As a consequence, the main part of the potassium will follow the cake resulting in a low removal efficiency for potassium. With the ion exchange the potassium concentration can be kept below solubility and potassium removal efficiency is improved.

Figure 2:
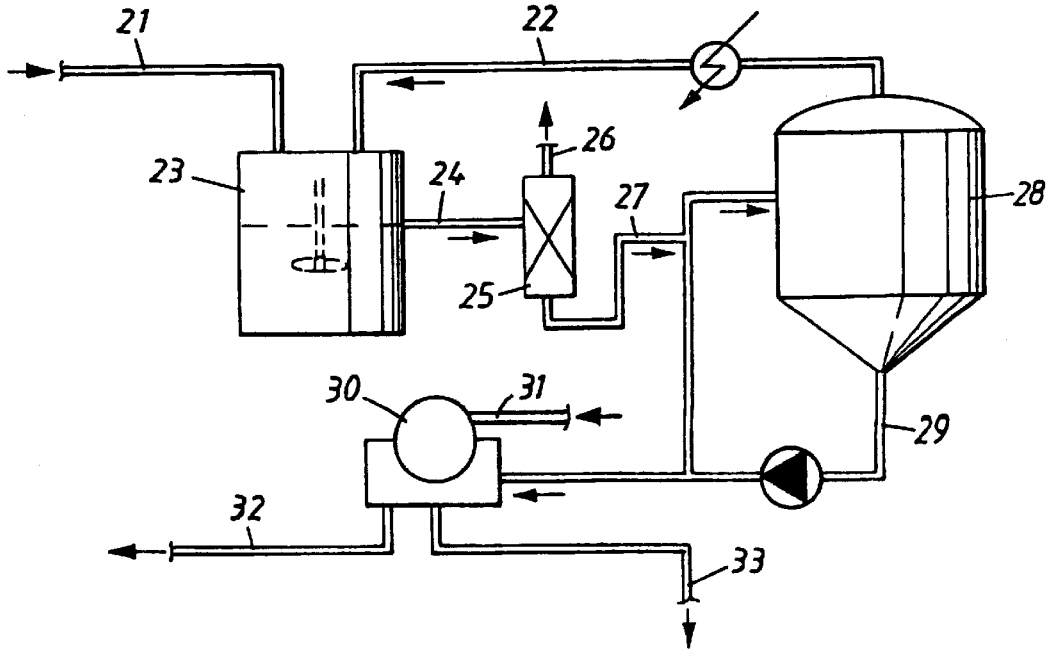
FIG. 2 shows the application of an inorganic ion exchanger in yet another embodiment in combination with a recrystallisation of sodium sulphate from precipitator dust.

In FIG. 2, an embodiment is shown where an ion exchanger is combined with a process where sodium sulphate is re-crystallised from the precipitator dust. Precipitator dust (21) can be mixed with water (22) (preferably condensate from the crystallisator (28)) in a dissolving tank (23). The dissolved solution (24) is forwarded to an ion exchange column (25), where potassium, are removed (26) and the potassium depleted filtrate (27), may further be brought to a crystallisator (28) where sodium sulphate is re-crystallised from the precipitator dust. The solution (29) containing mother liquor and sodium sulphate crystals is brought to a separation step with conventional technique, for instance a vacuum drum filter (30) and an addition of water (31), where the sodium sulphate crystals (32) ($Na_2SO_4$) are separated from the mother liquor (33). Condensed water (22) from the re-crystallisation (28) may be recycled to the dissolving step (23). The sodium sulphate crystals can be recycled to the strong black liquor, alternatively can a small portion of the crystals be dissolved in water and used for regeneration of the ion exchanger. The mother liquor is preferably discharged.

The process shown in FIG. 2, purges a stream of the mother liquor to control the potassium and chloride levels. As described in connection to FIG. 1 above, the limiting factor is the solubility of glacerite ($NaK_3(SO_4)_2$). When the potassium level is kept down, either by ion exchanging the feed solution or a small side stream of mother liquor, the chloride levels in the mother liquor can be increased and the purge flow can be reduced. In other words less sodium and sulphate are lost with the purge. The concentration of potassium in the precipitator dust solution may vary between 0 and about 35 g/l. After ion exchange, the solution fed to the crystallizator may have a potassium concentration down to 0 g/l.

The invention and its advantages are illustrated in more detail by the following examples which, however, are only intended to illustrate the invention and not to limit the same. The percentages and parts used in the description, claims and examples, refer to percentages by weight and parts by weight, unless otherwise specified.

EXAMPLE 1

A 20 wt % ash solution was prepared from a kraft mill precipitator dust, with a content in the ash of 32 wt % Na, 42 wt % $SO_4$, 3.0 wt % K, 3.4 wt % Cl, 16 wt % $CO_3$ and impurities<4 wt %. The pH of the solution was adjusted by 50% $H_2SO_4$ to pH 7 or 9 and filtered through an OOH filter paper. After that the solution contained about 7.5 g/l potassium. The ash solution was mixed with the zeolite and left for stirring for at least 10 minutes. The samples were run at 50° C. and the solution was heated and stirred at the same time. When the samples reached 50° C. they were stirred for 5 minutes more. For filtration of the solution, a Millipore equipment and a nylon filter paper with a pore size of 0.45 μm were used. The zeolites used in the examples were of two different types. The Wessalith P is a zeolite manufactured by Degussa. Sodium Mordenite EM120 is manufactured by Eka Chemicals in Bohus, Sweden. The tested zeolites were powder form. Analyses of potassium content were done on the ash, the start solution and on the filtrate. The experiments were run at pH 7, and at room temperature with different amounts of zeolites. In tables I and II below the results of the removal of potassium in % for each are shown. The amount of zeolite/100 ml ash solution has been recalculated as dry zeolite. The removal of potassium is calculated on the concentration in the start solution and the filtrate as follows:

$$\frac{K \text{ in start solution } (g/l) - K \text{ in filtrate } (g/l)}{K \text{ in start solution } (g/l)} \times 100 = \%\ \text{Removal of } K \text{ in the precipitator dust}$$

Table I shows the results from the experiments with Wessalith P.

TABLE I

| Test: | 1 | 2 | 3 | 4 | 5 |
|---|---|---|---|---|---|
| Amount zeolite [g]/100 ml solution | 3.9 | 5.8 | 7.8 | 31 | 38.8 |
| K in start solution, [g/l] | 7.2 | 7.2 | 7.2 | 7.4 | 7.4 |
| K after treatment, [g/l] | 6.5 | 6.1 | 5.9 | 3.9 | 3.7 |
| Removal of $K^+$ [%] | 10% | 15% | 18% | 47% | 50% |

As evident from table I, the removal of potassium with Wessalith P was efficient and increases with increasing addition of the zeolite.

Table II shows the results from the experiments with Zeolite Sodium Mordenite EM120.

TABLE II

| test: | 1 | 2 | 3 | 4 | 5 | 6 |
|---|---|---|---|---|---|---|
| Amount zeolite [g]/100 ml solution | 3.9 | 7.8 | 15.5 | 23.3 | 31 | 38.8 |
| K in start solution, [g/l] | 7.7 | 7.7 | 7.7 | 7.2 | 7.2 | 7.2 |
| K after treatment, [gl/] | 6.2 | 6.0 | 4.3 | 3.3 | 2.8 | 2.4 |
| Removal of $K^+$ [%] | 19% | 22% | 44% | 54% | 61% | 67% |

As shown in table II, the removal of potassium with Zeolite Sodium Mordenite EM120 was further improved, resulting in about 15% higher removal rate than with the Wessalith P zeolite.

EXAMPLE 2

A 20 wt % ash solution was prepared from the precipitator dust used in example 1. The pH of the solution was adjusted by 50% $H_2SO_4$ to pH 8. After that the solution contained about 7.7 g/l potassium. The ash solution was mixed with the zeolite and left for stirring for 5 hours at a temperature of 80° C. The zeolite used was Sodium Mordenite EM120 manufactured by Eka Chemicals in Bohus, Sweden. The zeolite was in powder form. 100 ml solution/20 g zeolite was used in this test. The start concentration of potassium is 7.7 g/l. Analyses of potassium content and the calculation of amount potassium removed were done in accordance with example 1. Samples were taken once every hour from the solution with the zeolite. The stirrer was turned off and sample was taken from the clear phase. In Table IIIl below the results of the removal of potassium in % for each hour is shown.

TABLE III

| Time [h]: | 1 | 2 | 3 | 4 | 5 |
|---|---|---|---|---|---|
| Removal of $K^+$ [%]: | 32.5 | 33.8 | 35.1 | 36.4 | 40.3 |

As evident from Table III, the removal of potassium with Zeolite Sodium Mordenite EM120 increased with time.

EXAMPLE 3

For comparative reasons, Amberlite IRC-718 (a cationic exchange resin) manufactured by Rohm and Haas was used in an experiment. Before start the resin was regenerated as follows:

1. 300 ml Amberlite was added to 1200 ml 4% HCl and stirred for 30 min.
2. Washed with water (Filter paper and funnel).
3. The Amberlite was added to 3000 ml 4% NaOH and stirred for 30 min.
4. Washed with water (water and Amberlite were mixed and stirred for some minutes and washed with the Amberlite as in 2, this was repeated several times). pH 10.9 after 3.5 hours.

A 20 wt % ash solution was prepared from the precipitator dust used in example 1. The pH of the solution was adjusted by 50% $H_2SO_4$ to pH 10. The solution contained after that about 7.5 g/l potassium. The ash solution was mixed with the wet ion exchanger and stirred for 30 min at 40° C. After that the solution was filtered. Analyses of potassium content and the calculation of the amount potassium removed were done in accordance with example 1. In Table IV below the results of the removal of potassium in % for each are shown. The amount of zeolite/100 ml ash solution has been recalculated as dry zeolite.

TABLE IV

| Test | 1 | 2 | 3 |
|---|---|---|---|
| Amount zeolite g/100 ml solution | 25 | 37.5 | 50 |
| K in start solution [g/l] | 7.5 | 7.5 | 7.5 |
| K after treatment [g/l] | 6.0 | 5.5 | 5.1 |
| Removal of K [%] | 20 | 26 | 32 |

As evident from Table IV, the removal of potassium with Amberlite IRC-718 is poor, compared to the inorganic ion exchange material used in examples 1 and 2.

EXAMPLE 4

In this experiment a continuous ion exchange was carried out. The equipment used were a glass column, a conduit for continuously separating a bleed from the top of the column to a balance, a balance with the feed solution in connection to a pump for continuously feeding the solution from the bottom of the column and a pump control unit. In each trial the column was packed with fresh zeolite granules. Potassium was analysed by AAS (Atomic Absorption Spectra). In trials no 1–3 a real precipitator dust solution was used. A 5 wt % solution was prepared from Weyerhaeuser precipitator dust (see example 1). The pH was adjusted by 50% $H_2SO_4$ to pH of 7 and the solution was filtered through a 00H filter paper. A new solution was prepared in each trial. Table V shows the precipitator dust solution content.

TABLE V

| K g/l | Na g/l | Cl g/l | SO4 g/l | pH |
|---|---|---|---|---|
| 1.5 | ~16 | ~1.7 | ~21 | 7 |

The used regeneration solutions have been 3 M NaAc and 3M $NH_4$ Cl. The variables can be seen in Table VI. $Re_x$= regeneration. $IE_x$=ion exchange. BV=Bed Volume. Trial no.1 is Wessalith MS 330, no. 2 is Ammonium Mordenite and no. 3 is Sodium mordenite.

TABLE VI

| Trial No. | Amount Zeolite [g] | Flow [BV/h] | IE time [min] | Temp [° C.] | Performed series | Regeneration (Re), Solution, time |
|---|---|---|---|---|---|---|
| 1 | 30.1 | 18 | 100 | 25 | $Re_0$ $IE_1$ $Re_1$ $IE_1$ $IE_2$ | $NH_4Cl$ 90 minutes |
| 2 | 27 | 18 | 100 | 25 | $Re_0$ $IE_1$ $Re_1$ $IE_1$ $IE_2$ | NaAc 90 minutes |
| 3 | 31 | 18 | 100 | 25 | $Re_0$ $IE_1$ $Re_1$ $IE_1$ $IE_2$ | $NH_4Cl$ 90 minutes |

In Table VII below, the continuous ion exchange on precipitator dust solution is shown.

TABLE VII

| Zeolite type/ trial No | IE-stage | Rem % K 20 minutes | Rem % K 50 minutes | Rem % K 70 minutes | Rem % K 100 minutes |
|---|---|---|---|---|---|
| Wessalith MS 330/ trial no.1 | $IE_1$ | 41.1 | 26.9 | 22.5 | 18.2 |
| | $IE_2$ | 39.9 | 26.7 | 21.9 | 17.7 |
| Ammonium Mordenite EM 032/ trial no. 2 | $IE_1$ | 50.4 | 35.8 | 30.9 | 25.7 |
| | $IE_2$ | 45.1 | 33.2 | 28.4 | 23.0 |
| Sodium Mordenite EM 120/ trial no. 3 | $IE_1$ | 65.2 | 52.8 | 44.5 | 36.2 |
| | $IE_2$ | 76.5 | 44.3 | 37.2 | 29.6 |

As evident from Table VII above, it is possible to achieve a high removal of potassium from a precipitator dust solution when using a continuous operation. The results from these trials also show that the zeolites can be regenerated and used again.

We claim:

1. A process for reducing the content of potassium ions in a recovery system for pulping chemicals which comprises bringing spent liquor to a recovery boiler, burning said spent liquor, collecting precipitator dust formed, and forming a solution by dissolving the precipitator dust in a liquid, wherein the solution of precipitator dust is subjected to a treatment with an inorganic ion exchange material in order to remove at least a part of the potassium therein.

2. The process of claim 1 wherein the inorganic ion exchange material comprises an aluminosilicate.

3. The process of claim 1 wherein the inorganic ion exchange material comprises a zeolite.

4. The process of claim 3 wherein said zeolite is selected from the group consisting of mordenite, chabazite, clinoptilolite, zeolite A and zeolite Y.

5. The process of claim 1 wherein the treatment is carried out batchwise, with a residence time of at least about 2 hours.

6. The process of claim 1 wherein the treatment is carried out in a continuous operation, with a flow rate from about 1 up to 10 BV/h.

7. The process of claim 1 wherein the precipitator dust is subjected to leaching and electrodialysis prior to, during, or after treatment with the inorganic ion exchange material.

8. The process of claim 1 wherein sodium sulphate is re-crystallized from the precipitator dust prior to, during, or after treatment with the inorganic ion exchange material.

9. The process of claim 1 wherein the inorganic ion exchange material is regenerated with an internal chloride concentrated solution received in the process for removal of potassium and chloride ions from precipitator dust.

10. The process of claim 1 wherein the amount of potassium removed from said precipitator dust solution, subjected to the treatment with said inorganic ion exchange material, is above about 50%.

* * * * *